United States Patent [19]

Nelson

[11] Patent Number: 4,745,640

[45] Date of Patent: May 24, 1988

[54] TOILET SEAT COVER

[75] Inventor: Eric L. Nelson, Newport Beach, Calif.

[73] Assignee: Nelson Research & Development Co., Irvine, Calif.

[21] Appl. No.: 42,712

[22] Filed: Apr. 27, 1987

[51] Int. Cl.[4] ..... A47K 13/14

[52] U.S. Cl. ..... 4/243; 428/402.21; 428/321.5; 424/408; 424/455

[58] Field of Search ..... 4/242–247; 428/402.2, 402.21, 402.22, 312.5; 424/141, 431, 408, 455; 252/188.31; 422/28, 29; 604/358–360

[56] References Cited

U.S. PATENT DOCUMENTS

| | | | |
|---|---|---|---|
| 3,681,492 | 8/1972 | Kotzbauer | 424/141 |
| 3,896,033 | 7/1975 | Grimm | 428/402.2 |
| 3,967,325 | 7/1976 | Rodriguez | 4/245 |
| 4,010,497 | 3/1977 | Menter | 4/243 |
| 4,050,105 | 9/1977 | Marceaux | 4/243 |
| 4,297,750 | 11/1981 | Lutz | 4/247 |
| 4,309,469 | 1/1982 | Varona | 428/74 |
| 4,352,214 | 10/1982 | Finkenweg | 4/243 |
| 4,362,781 | 12/1982 | Anderson | 428/291 |
| 4,532,123 | 7/1985 | Gardner | 428/402.21 |
| 4,585,792 | 4/1986 | Jacob et al. | 424/431 |
| 4,654,256 | 3/1987 | Doree et al. | 428/321.5 |

FOREIGN PATENT DOCUMENTS

| | | | |
|---|---|---|---|
| 2440489 | 4/1976 | Fed. Rep. of Germany | 4/243 |
| 3305265 | 8/1984 | Fed. Rep. of Germany | 4/243 |
| 1363225 | 8/1974 | United Kingdom | 4/243 |
| 1514216 | 10/1978 | United Kingdom . | |
| 2097832 | 11/1982 | United Kingdom | 4/247 |

*Primary Examiner*—Henry J. Recla
*Assistant Examiner*—L. J. Peters
*Attorney, Agent, or Firm*—Walter A. Hackler; Robert J. Baran

[57] ABSTRACT

A toilet seat cover is provided for preventing contact between the human buttocks and the toilet seat when the sheet is disposed and aligned with the toilet seat. A microbiocidal shield is created by the perspiration from the buttocks contacting a water-soluble oxidizing agent along with a water-soluble ene-diol compound dispersed as separate particles in the sheet. The water-soluble oxidizing agent and water-soluble ene-diol compound may be separately microencapsulated by a protective film. Capillary action of the fibers in the sheet provide for conducting free water released during reaction between the water-soluble oxidizing agent and the ene-diol compound throughout the toilet seat cover. Fibers of the sheet are adhesively bonded together within the adhesive that is soluble and dispersible in water to enable the toilet seat cover to be flushed down the toilet after use.

13 Claims, 1 Drawing Sheet

TOILET SEAT COVER

The present invention generally relates to a disposable toilet seat cover. More particularly, the present invention relates to a flushable toilet seat cover which enables the hygienic use of public toilets.

Public awareness regarding communicable diseases has hightened in recent years, and public washrooms in particular have been identified by the public as "high risk" areas.

The present invention provides an improved toilet seat cover which, when properly disposed between a user and a toilet seat, provides an effective microbiocidal shield, or barrier, between the user and the toilet seat.

SUMMARY OF THE INVENTION

A toilet seat cover in accordance with the present invention includes a sheet having means defining a toilet seat shape with sufficient area to prevent contact between a human buttocks and a toilet seat when the sheet is disposed on and aligned with a toilet seat. A water-soluble oxidizing agent along with a water-soluble ene-diol compound are provided in the sheet in amounts sufficient to provide a microbiocidal shield between the toilet seat and the buttocks when perspiration from the buttocks contacts both the water-soluble oxidizing agent and the water-soluble ene-diol compound. The microbiocidal shield comprises a microbiocidal solution of the water-soluble oxidizing agent and the water-soluble ene-diol compound suspended in the sheet.

More particularly, the sheet includes capillary means for absorbing perspiration and holding the microbiocidal solution within the sheet. The capillary means may include a fibrous matrix and the water-soluble oxidizing agent and may include a water-soluble catalytic metal compound preferably selected from the group consisting of copper sulfate, copper acetate and copper chloride.

In a preferred embodiment, the ene-diol compound is selected from the group consisting of ascorbic acid compounds, reductic acid, squaric acid, diahydroxymaleic, and dehydroxyfumaric acid. In this embodiment, the oxidation of the ene-diol produces free water and said fibrous matrix has sufficient capillary action to enable the free water to disperse within the fibrous matrix for contacting adjacent water-soluble oxidizing agent and ene-diol compound in order to produce additional microbiocidal solution. Importantly, the sheet is constructed from a water disintegrateable material which is suitable for flushing down a toilet subsequent to use thereof.

The present invention may also be defined as an article of manufacture, a microbiocidal sheet for disinfecting the skin of a human, comprising as separate particles uniformly dispersed therethrough, (a) a water-soluble copper salt or compound, and (b) a water-soluble ene-diol compound. The separate particles are present in amounts sufficient to, when contacted with perspiration, provide a microbiocidal solution of copper ions and said ene-diol compounds in said perspiration and the sheet provides means for retaining the microbiocidal solution therein. When the sheet is configured to the shape of the toilet seat and formed from a fibrous matrix, it is suitable for interfacing between the buttocks of a human and a toilet seat and adapted to provide a microbiocidal solution of copper ions and an ene-diol compound upon compressive, gluteal contact therewith.

BRIEF DESCRIPTION OF THE DRAWINGS

A better understanding of the present invention may be had from the consideration of the following detailed description, taken in conjunction with the accompanying drawings, in which.

DETAILED DESCRIPTION

Figure 2:
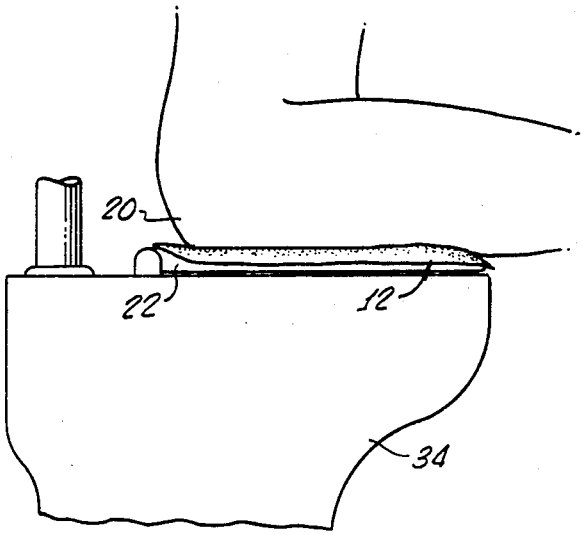
FIG. 2 is a side view of a commode having a toilet seat thereon with the toilet seat cover in accordance with the present invention disposed thereon and aligned between the buttocks of a human in order to provide a microbiocidal shield or barrier therebetween.
Figure 1:
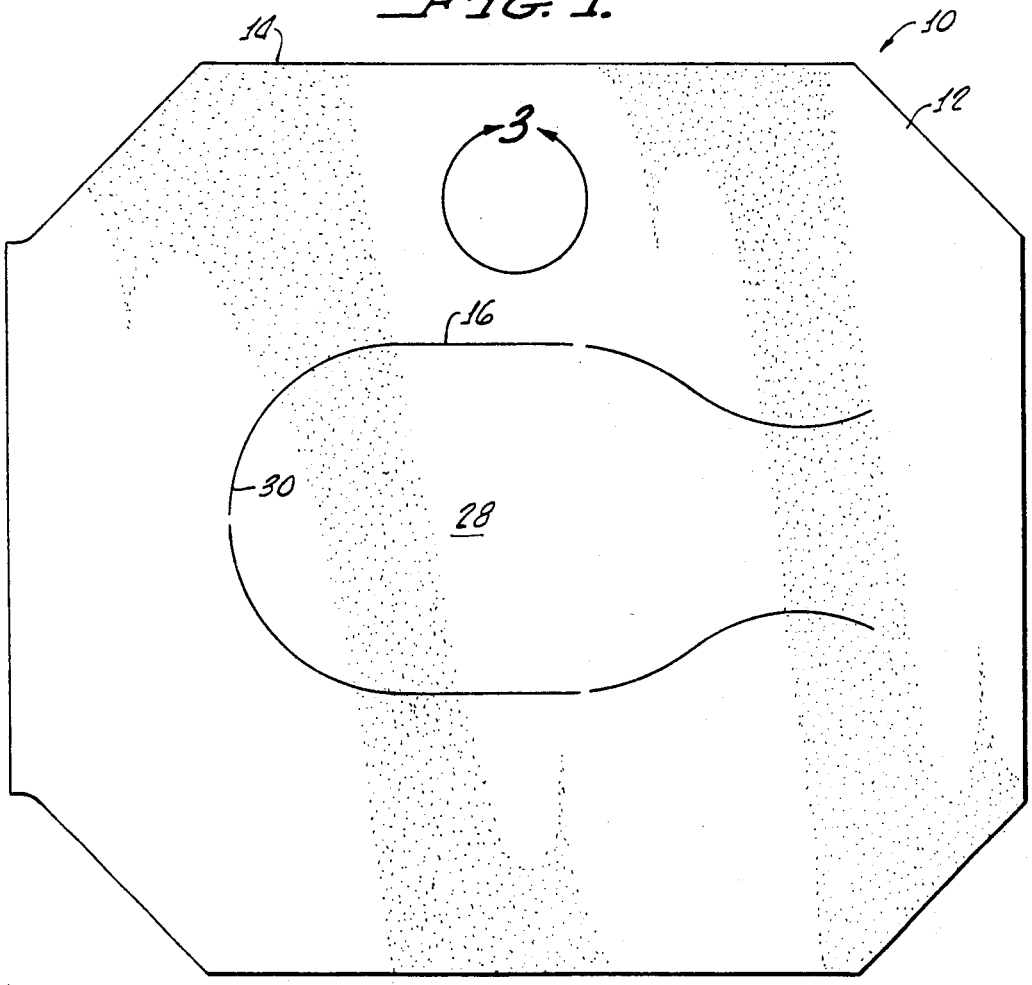
FIG. 1 is a plan view of a preferred embodiment of the present invention showing a sheet having a toilet seat shape with sufficient area to prevent contact between a human buttocks and the toilet seat when the sheet is disposed on and aligned with a toilet seat.

Turning now to FIG. 1, a toilet seat cover 10 in accordance with the present invention, generally includes a sheet 12 having an outside perimeter 14 and an inside perimeter 16 which are cut and shaped to provide means defining a toilet seat shape with sufficient area between the outside and inside perimeters 14 and 16 to enable the sheet to prevent contact between a human buttocks 20 and a toilet seat when the sheet 12 is disposed on and aligned with the toilet seat 22 as shown in FIG. 2.

As shown in FIG. 1, the sheet 12 may include a central portion 28 which, when moistened, separates from the inside perimeter 16 of the sheet 12 along a perforated cut 30 in the sheet 12 defining the inside perimeter 16.

Figure 3:
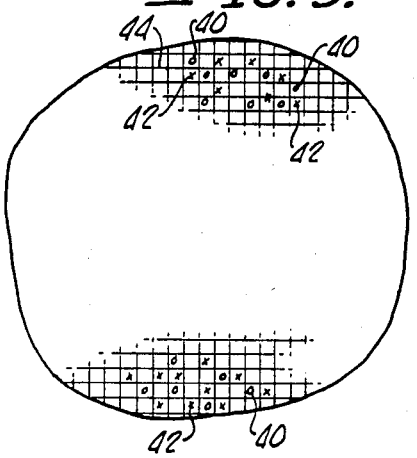
FIG. 3 is an enlarged view of the toilet seat cover shown in FIG. 1 taken from the section indicated along the line 3 illustrating separate particles of a water-soluble copper salt or compound and a water-soluble ene-diol compound dispersed within a fibrous matrix of the toilet seat cover.

The sheet preferably consists of a fibrous matrix of cellulose fibers adhesively bonded together with an adhesive which is soluble or dispersible in water to cause separation of the fibers when the sheet is saturated with water as it is flushed down a toilet 34 (FIG. 2). Other fibers suitable for the present invention are those formed of rayon, polyolefin, polyester and nylon, among others, and the water-soluble or dispersible adhesives for binding the fibers are well known in the art. Disposed in or on the sheet 10, preferably in the form of separate particles 40, is a water-soluble ene-diol compound. FIG. 3 is an enlargement of a section of the sheet 12 shown in FIG. 1 and is a representation of the separate disposition of the ene-diol compound particles 40 and separate particles 42 of a water-soluble oxidizing agent. As hereinafter described, the particles 40, 42 may be microcapsules.

The water-soluble oxidizing agent and the water-soluble ene-diol compound are present in this sheet 10 in an amount sufficient to provide a microboiocidal shield between the toilet seat 22 and the buttocks 20 when perspiration (not shown) from the buttocks contacts both the water-soluble oxidizing agent particles 40 and the water-soluble ene-diol compound particles 42. As shown in FIG. 3, the sheet 12 includes a matrix of fibers 44 which provides capillary means for absorbing perspiration and holding microbiocidal solution within the sheet.

An ene-diol compound suitable for the present invention may be any water-soluble compound having two hydroxyl groups on adjacent carbon atoms which are connected with an ethylenic double bond. Ene-diol compounds of this type are ascorbic acid compounds, squaric acid, dihydroxymaleic acid and dehydroxyfumaric acid. The preferred ene-diol compounds are ascorbic acid compounds which include the various forms of ascorbic acid itself, such as sodium ascorbate, ascorbic acid esters, such as ascorbyl palmitate, and derivatives that retain the ene-diol molecular structure. The preferred ene-diol compounds are ascorbic acid and sodium ascorbate.

Preferably, the water-soluble oxidizing agent comprises a water-soluble catalytic metal compound.

Catalytic metal compounds useful in this invention include water-soluble compounds of copper, iron, cobalt, nickel, manganese, and titanium. The preferred catalytic metal is copper, particularly cupric compounds, and the particularly preferred compound is cupric chloride because it is highly soluble, non-corrosive, relatively neutral and readily available. The anydrous, monohydrate, or dihydrate forms of cupric chloride may be used.

It is well known that rapid oxidation of an ene-diol compound in the presence of copper ions effectively kills microorganisms upon contact. Although this microbiocidal effect is well known, commercial use is restricted because of the transient nature of the biocidal effect, which occurs during the oxidation of the ene-diol compound and, therefore, presents significant shelf-life problems. That is, the ene-diol compounds and oxidizing agent are not stable when they are stored in contact with one another because any absorption or mutual contact with water will enable the oxidizing reaction to occur.

Hence, it is important to suspend the oxidizing agent particles 40 and the ene-diol compound particles 42 separately within the sheet 12 without premature contact of the particles by water. To accomplish this, the copper salt or compound particles 40 and ene-diol compound particles 42 may be microencapsulated and disposed in or on the sheet 12 by any suitable manner well known in the art as for example, set forth in *Microcapsule Processing and Technology,* Kondo, Asaji, Marcel Deckker, Inc., New York, 1979. This reference is incorporated herewith by specific reference thereto.

In this configuration, the copper salt, or compound and the ene-diol compound each become core material of the microcapsule and because they are water-soluble, the protective film or wall material, surrounding the core, is preferably insoluble, such as a water-insoluble synthetic polymer, in order to prevent premature water contact between the copper salt, or compound, and the ene-diol due to water absorption by the sheet which may occur during storage thereof.

Any suitable film or wall material may be used and is selected and formed with a thickness to enable rupture thereof by compression when the sheet 10 is pressed against the toilet seat 22 by the buttocks 20. Examples of commonly employed wall material are as follows:

Proteins: collagen, gelatin, casein, fibrinogen, hemoglobin, and polyamino acids;

Vegetable gums: gum arabic, agar, sodium alginate, carrageenin, and dextran sulfate;

Celluloses: ethyl cellulose, nitrocellulose, carboxymethyl cellulose, acetylcellulose, cellulose acetate-phthalate, and cellulose acetate-butylate-phthalate;

Condensation polymers: nylon, Tetron, polyurethane, polyurea, polycarbonate, formalin naphthalenesulfonic acid condensate, amino resins, alkyd resins, and silicone resins;

Copolymers: maleic anhydride copolymers with ethylene or vinyl methyl ether, acrylic acid copolymers, and methacrylic acid copolymers;

Homopolymers: polyvinyl chloride, Saran, polyethylene, polystyrene, polyvinyl acetal, polyacrylamide, polyvinylbenzenesulfonic acid, polyvinyl alcohol, and synthetic rubbers;

Curable polymers: epoxy resins, nitroparaffin, and nitrated polystyrene

Waxes: wax, paraffin, rosin, shellac, tristearin, monoglyceride, beeswax, haze wax, oils, fats, and hardened oils;

Inorganic materials: calcium sulfate, graphite, silicates, aluminum, alumina, copper, silver, glass, alloys, and clays.

As hereinabove noted, the copper salt or compound and the ene-diol compound may be encapsulated and disposed in or on the sheet in any suitable chemical, physiocochemical or mechanical process.

It is, of course, important that the particles 40, 42 are dispersed evenly throughout the sheet 12 in order to provide a uniformal biocidal shield when they are moistened by perspiration.

The reaction between the copper salt, or compound, and the ene-diol compound produces free water. This result is used to advantage in the present invention to enhance the uniformity of the microbiocidal shield produced. This occurs because the fibrous matrix of the sheet holds and conducts such free water, by capillary action, to adjacent copper salt, or compound, and ene-diol compound which then react.

Hence, both perspiration and free water produced by the reaction are uniformly dispersed throughout the sheet thereby activating all of the oxidizing action and ene-diol compound.

Sufficient capillary action may be achieved by the selection and density of fibers utilized along with the type and amount of adhesive for fabricating the sheet 12. All these parameters may be determined by one skilled in the art without undue experimentation.

Although there has been described hereinabove a specific toilet seat cover, or article of manufacture, in accordance with the present invention, for the purposes of illustrating the manner in which the invention may be used to advantage, it will be appreciated that the invention is not limited thereto. Accordingly, any and all modifications, variations, or equivalent arrangements which may occur to those skilled in the art, should be considered to be within the scope of the invention as defined in the appended claims.

What is claimed is:

1. A toilet seat cover comprising:

a sheet including means defining a toilet seat shape having sufficient area to prevent contact between a human buttocks and a toilet seat when the sheet is disposed on and aligned with said toilet seat;

a water-soluble oxidizing agent disposed in said sheet in the form of separate particles;

a water-soluble ene-diol compound disposed in said sheet in the form of separate particles;

said water-soluble oxidizing agent and said water-soluble ene-diol compound being present in said sheet in an amount sufficient to provide a microbiocidal shield between the toilet seat and said buttocks when perspiration from the buttocks contacts both the water-soluble oxidizing agent and the water-soluble ene-diol compound, said microbiocidal shield comprising a microbiocidal solution of said water-soluble oxidizing agent and said water-soluble ene-diol compound suspended in said sheet.

2. The toilet seat cover of claim 1 wherein said sheet further comprises capillary means for absorbing perspiration and holding said microbiocidal solution within the sheet.

3. The toilet seat cover of claim 2 wherein the oxidation of the ene-diol produces free water and said fibrous matrix has sufficient capillary action to enable said free water to disperse within the fibrous matrix for contacting adjacent water-soluble oxidizing agent and ene-diol compound in order to produce additional microbiocidal solution.

4. The toilet seat cover of claim 3 wherein said capillary means comprises a fibrous paper matrix and the sheet comprises a water-soluble or dispersible adhesive means for bonding said fibrous paper matrix and causing said fibrous matrix to separate upon water saturation thereof.

5. The toilet seat cover of claim 4 wherein said water-soluble oxidizing agent comprises a water-soluble catalytic metal compound.

6. The toilet seat of claim 5 wherein the catalytic metal compound comprises a copper salt or compound.

7. The toilet seat cover of claim 6 wherein said copper salt or compound is selected from the group consisting of copper sulfate, copper acetate and copper chloride.

8. The toilet seat cover of claim 7 wherein said ene-diol compound is selected from the group consisting of ascorbic acid compounds, reductic acid compounds, squaric acid, dihydroxymaleic acid, and dehydroxyfumaric acid.

9. The toilet seat cover of claim 7 wherein said ene-diol compound is selected from the group consisting of ascorbic acid, sodium ascorbate, ascorbic acid, esters and derivatives that retain the ene-diol molecular structure.

10. The toilet seat cover of claim 1 wherein the water-soluble oxidizing agent and the water-soluble ene-diol compound are separately microencapsulated by a protective film, said protective film being rupturable by external pressure applied thereto during compression of said sheet on said toilet seat during use.

11. The toilet seat cover of claim 10 wherein said protective film is water-soluble in order to prevent premature water contact between the water-soluble oxidizing agent and water-soluble ene-diol compound due to water absorption by said sheet during storage thereof.

12. The toilet seat cover of claim 11 wherein said protective film comprises a water-insoluble synthetic polymer.

13. The toilet seat cover of claim 11 wherein said protective film is selected from a group consisting of proteins, vegetable gums, celluloses, condensation polymers, copolymers, homopolymers, curable polymers, waxes and inorganic materials.

* * * * *